US008539707B1

(12) United States Patent
Di Trolio

(10) Patent No.: US 8,539,707 B1
(45) Date of Patent: Sep. 24, 2013

(54) DEVICE TO PREVENT OVER-ROTATION OF PISTOL EJECTOR

(75) Inventor: Lucio Di Trolio, Mineola, NY (US)

(73) Assignee: Kimber IP, LLC, Yonkers, NY (US)

( * ) Notice: Subject to any disclaimer, the term of this patent is extended or adjusted under 35 U.S.C. 154(b) by 0 days.

(21) Appl. No.: 13/494,441

(22) Filed: Jun. 12, 2012

(51) Int. Cl.
*F41A 19/00* (2006.01)

(52) U.S. Cl.
USPC ..... 42/69.01; 42/25

(58) Field of Classification Search
USPC ..... 42/7, 16, 25, 69.01, 69.02, 69.03
See application file for complete search history.

(56) References Cited

U.S. PATENT DOCUMENTS 4,021,955 A * 5/1977 Curtis ..... 42/70.08
4,536,981 A * 8/1985 Giragosian ..... 42/69.03
4,589,327 A * 5/1986 Smith ..... 89/148
4,627,184 A * 12/1986 Ruger et al. ..... 42/25
5,267,406 A * 12/1993 Ruger et al. ..... 42/25
2005/0229459 A1* 10/2005 McGarry ..... 42/7
2010/0236121 A1* 9/2010 McGarry ..... 42/69.02

* cited by examiner

*Primary Examiner* — Gabriel Klein
(74) *Attorney, Agent, or Firm* — Caesar, Rivise, Bernstein, Cohen & Pokotilow, Ltd.

(57) ABSTRACT

A pistol having a device to prevent ejector over-rotation is provided. The pistol includes a frame having an upper rear portion having a left side wall and a right side wall. An ejector has a first end, a second end and a pivot point. The first end has a cam surface for ejection of a spent case. The second end contacts an over-rotation stop. A sear spring is adjacent to the upper rear portion and has a cantilevered spring leg disposed adjacent to the second end of the ejector to rotably bias the ejector downward such that the first end of the ejector pivots upward. A stop is disposed between said left and right side walls to engage the second end of the ejector to limit rotational travel past the spring leg of the sear spring.

4 Claims, 5 Drawing Sheets

DEVICE TO PREVENT OVER-ROTATION OF PISTOL EJECTOR

BACKGROUND OF THE INVENTION

The present invention is generally directed to firearms. More particularly, the present invention is directed to a device to prevent over-rotation of an ejector in a pistol.

An ejector in certain types of pistols, for example, a pistol that was produced in the 1980s and 1990s, is an elongate device disposed between the walls of the pistol's frame, that, after firing of the pistol, causes the spent case to eject from the firearm. The ejector has a first end that contacts the spent case and is pivotally mounted at a pivot point to rotate upwardly to eject the spent case. The second end, contacts the sear spring, which biases the ejector toward its upward position (the sear spring always is in contact with the ejector).

A common issue with the ejector in such pistols occurs primarily when reassembling the slide on the pistol frame. Specifically, the ejector, in its normal upright position, blocks the slide from moving into its proper position on the frame. In order to fully assemble the slide onto the frame, the ejector must be manually rotated down into the frame. When the first end of the ejector is pressed such that it rotates down into the frame, if it is inadvertently pressed too far, the second end of the ejector (opposite its pivot point from the first end), rotates past the sear spring such that the second end "snaps" past the end of one of the cantilevered legs of the sear spring such that it is blocked from returning to its normal position. Repositioning the ejector to its proper operation requires a difficult procedure involving removal of the slide (likely, already removed from the frame), one of the grip handles, and manually pressing the cantilevered leg of the sear spring in such that the ejector is free to rotate back around to its normal position.

It would be desirable to provide a device to prevent such over-rotation of the ejector.

All references cited herein are incorporated herein by reference in their entireties.

BRIEF SUMMARY OF THE INVENTION

In an exemplary embodiment of the present invention, a pistol is provided having a device to prevent ejector over-rotation. The pistol includes a frame having a handle portion for receipt of a magazine, a barrel portion for receipt of a barrel, and an upper rear portion for receipt of a firing mechanism. The upper rear portion has a left side wall and a right side wall. An elongate ejector is provided having a first end, a second end and a pivot point between the first end and the second end.

The first end has a cam surface for ejection of a spent case. The second end is for contacting an over-rotation stop. The ejector is rotatably disposed in the frame between the left side wall and the right side wall at the pivot point. A sear spring is disposed adjacent to the upper rear portion and has at least one cantilevered spring leg disposed adjacent to the second end of the ejector to rotably bias the ejector downward such that the first end of the ejector pivots in an upward direction. An over-rotation stop is disposed between the left side wall and the right side wall to engage the second end of the ejector to limit rotational travel of the ejector past the spring leg of the sear spring.

The pivot point may be a pin installed through at least one aperture in the frame. The over-rotation stop may be a pin installed through at least one aperture in the frame.

In a more detailed exemplary embodiment of the present invention, a pistol is provided having a device to prevent ejector over-rotation. The pistol includes a frame having a handle portion for receipt of a magazine, a barrel portion for receipt of a barrel, and an upper rear portion for receipt of a firing mechanism. The upper rear portion has a left side wall and a right side wall. A left side wall ejector pin aperture, and a right side wall ejector pin aperture are provided. The left side wall ejector pin aperture is aligned with the right side wall ejector pin aperture. The left side wall ejector pin aperture and the right side wall ejector pin aperture are disposed in the upper rear portion for receipt of an ejector pivot pin. At least one over-rotation pin aperture is provided in either the left side wall or the right side wall or both. The at least one over-rotation pin aperture is disposed adjacent to the ejector pin apertures. An elongate ejector is provided having a first end, a second end and a pivot point aperture between the first end and the second end. The first end has a cam surface for ejection of a spent case. The second end is for contacting an over-rotation pin. The ejector is rotatably disposed in the frame between the left side wall and the right side wall by an ejector pivot pin. A sear spring is disposed adjacent to the upper rear portion where the sear spring has at least one cantilevered spring leg disposed adjacent to the second end of the ejector to rotatably bias the ejector downward such that the first end of the ejector pivots in an upward direction. The over-rotation pin is disposed in the over-rotation pin apertures to provide an over-rotation stop to engage the second end of the ejector to limit rotational travel of the ejector past the cantilevered spring leg of the sear spring.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiments, but it should be understood that the present invention is not deemed to be limited thereto.

Figure 1:
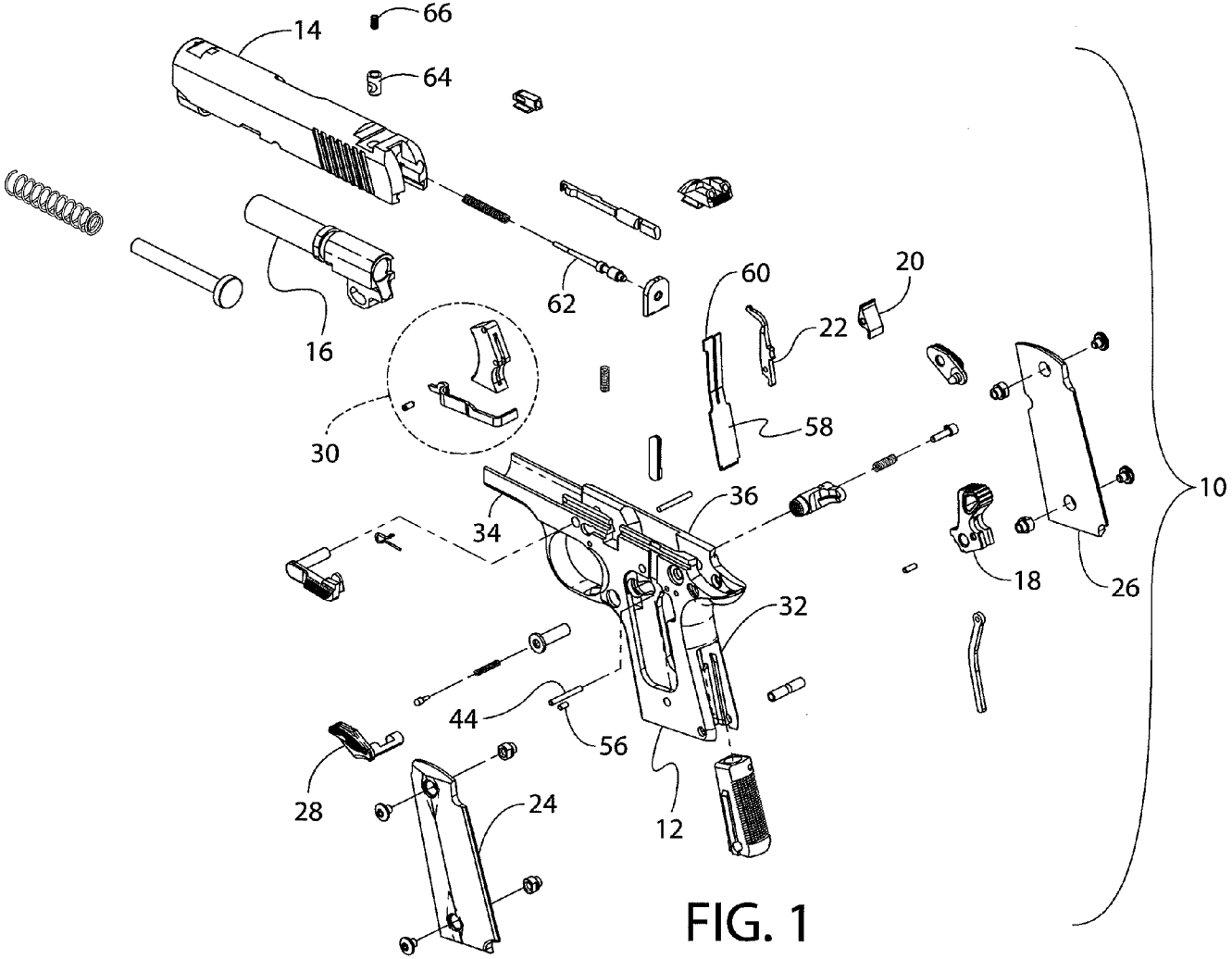
FIG. 1 is an exploded isometric view of a pistol having a device to prevent ejector over-rotation in accordance with an exemplary embodiment of the present invention.
Figure 2:
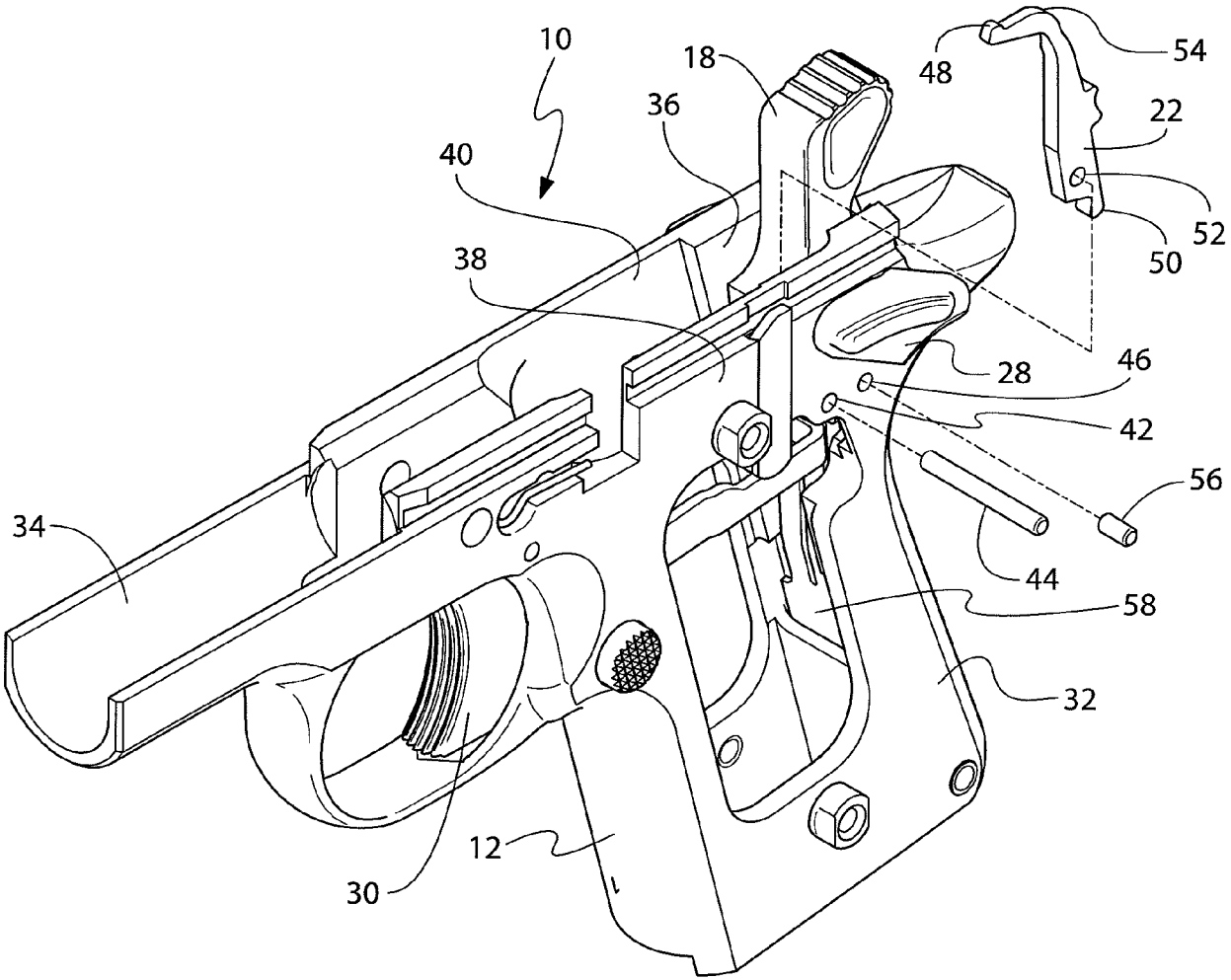
FIG. 2 is a partially exploded isometric view of the frame and some internal components of the pistol of FIG. 1.
Figure 3:
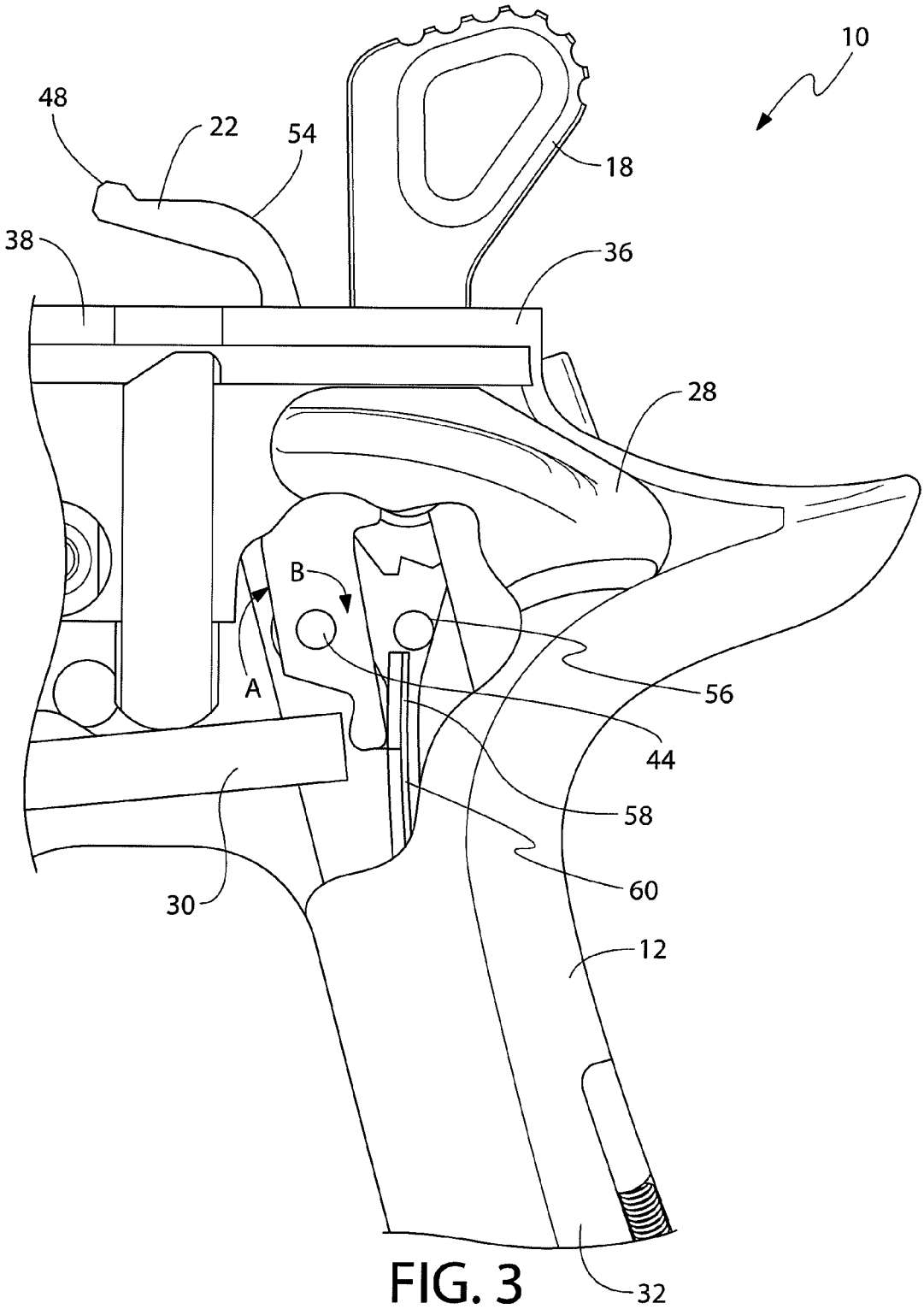
FIG. 3 is a side elevation, partially cutaway view of the frame and some internal components of FIG. 2, shown with its ejector in an up position.
Figure 4:
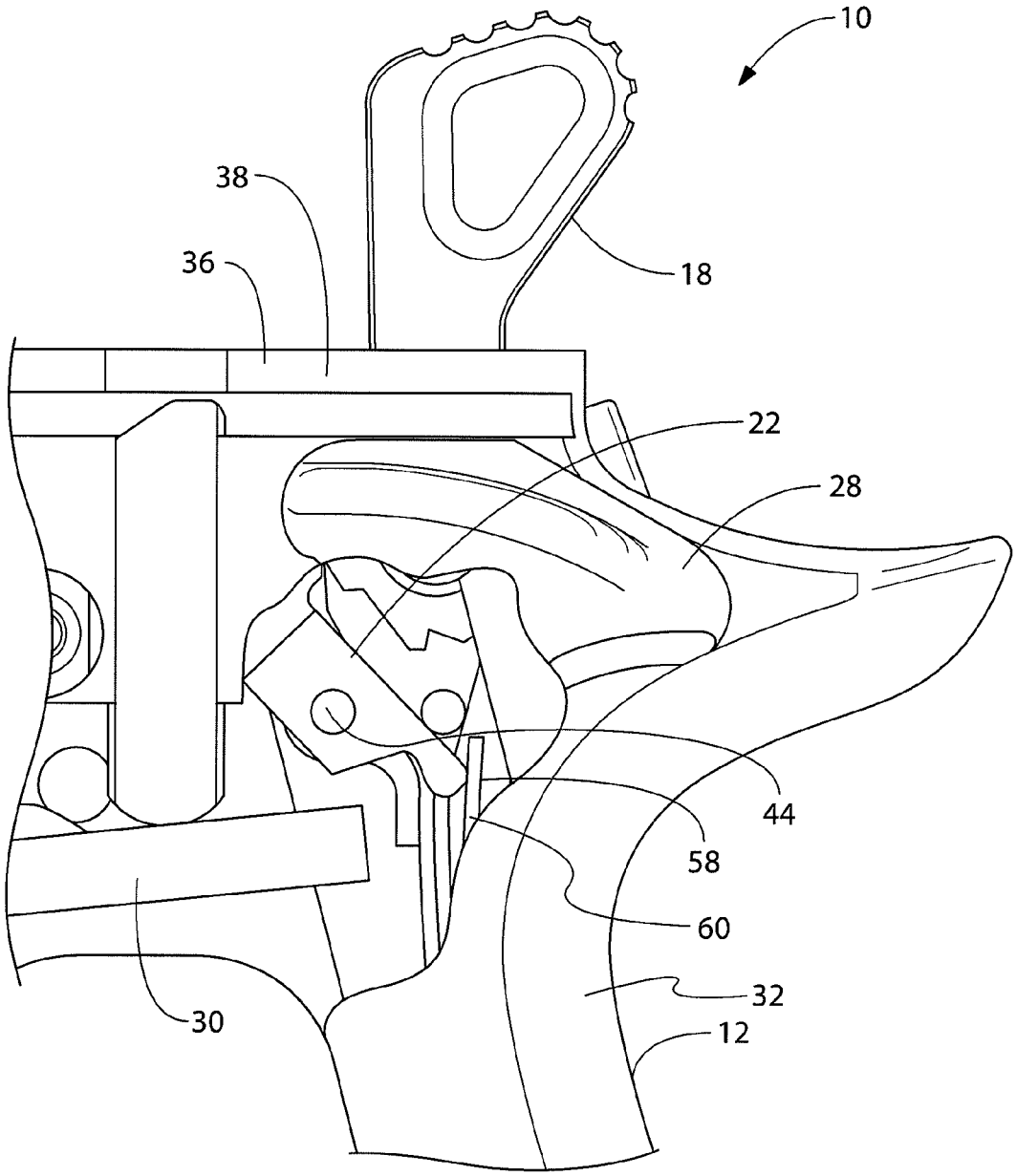
FIG. 4 is a side elevation, partially cutaway view of the frame and some internal components of FIG. 2, shown with its ejector in an down position.

Referring now to the drawing figures, wherein like part numbers refer to like elements throughout the several views, there is shown in FIGS. 1-4, a pistol 10 having a device to prevent ejector over-rotation in accordance with an exemplary embodiment of the present invention. As can be seen in FIG. 1, the pistol 10 has a frame 12, a slide 14, a barrel 16, a hammer 18, a sear 20, an ejector 22, grips 24, 26, a safety 28, a magazine (not shown), a trigger assembly 30, a firing pin assembly and other elements. The frame 12 of the pistol 10 includes a handle portion 32 for receipt of the magazine, a barrel portion 34 for receipt of the barrel 16, and an upper rear portion 36 for receipt of the firing mechanism. The upper rear portion 36 has a left side wall 38 and a right side wall 40.

The left side wall 38 has an ejector pin aperture 42, and a right side wall ejector pin aperture (not shown, but opposite to and coaxial with the left side wall ejector pin aperture). That is, the left side wall ejector pin aperture 42 is aligned with the right side wall ejector pin aperture such that a single ejector pin 44 may be disposed in both apertures. The left side wall ejector pin aperture 42 and the right side wall ejector pin aperture are disposed in the upper rear portion 36 for receipt of an ejector pivot pin 44.

The left side wall 38 and/or the right side wall 40 have an over-rotation pin aperture 46 (only an aperture 46 in the left side wall 38 is shown). The over-rotation pin aperture 46 is disposed adjacent to one or both of the ejector pin apertures 42 (between the ejector pin aperture 42 and the rear of the pistol 10). Like the ejector pin apertures 42, the left side wall over-rotation pin aperture 46 is aligned with the right side wall over-rotation pin aperture, if used.

The ejector 22 is an elongate article having a first end 48, a second end 50 and a pivot point aperture 52 between the first end 48 and the second end 50. The first end 48 has a cam surface 54 contact with and ejection of a spent case (not shown). The second end 50 contacts an over-rotation pin or stop 56 which will be explained more fully below. The ejector 22 is rotatably disposed in the frame 12 between the left side wall 38 and the right side wall 40 and is held in place by the ejector pivot pin 44.

A sear spring 58 is disposed adjacent to the upper rear portion 36 of the frame 12. The sear spring 58 has at least one cantilever spring leg 60 disposed adjacent to the second end 50 of the ejector 22 to rotatably bias the ejector 22 downward (in Direction A) such that the first end 48 of the ejector 48 pivots in an upward direction (Direction B).

The over-rotation pin 56 is disposed in the over-rotation pin aperture 46 to provide an over-rotation stop that engages the second end 50 of the ejector 22 to limit rotational travel of the ejector 22 past the cantilever spring leg 60 of the sear spring 58.

The main function of the ejector 22 is as described above. However, the ejector 22 has a secondary function to unblock the firing pin 62 (see FIG. 1). A firing pin block 64 is provided which is biased by spring 66 against the top of the ejector 22. When the trigger of the trigger assembly 30 is pulled, the ejector 22 rotates forward (toward the muzzle end of the pistol 10 about pivot pin 44 and allows the firing pin block 64 to drop and unblock the firing pin just before the hammer 18 strikes the firing pin 62.

Figure 5:
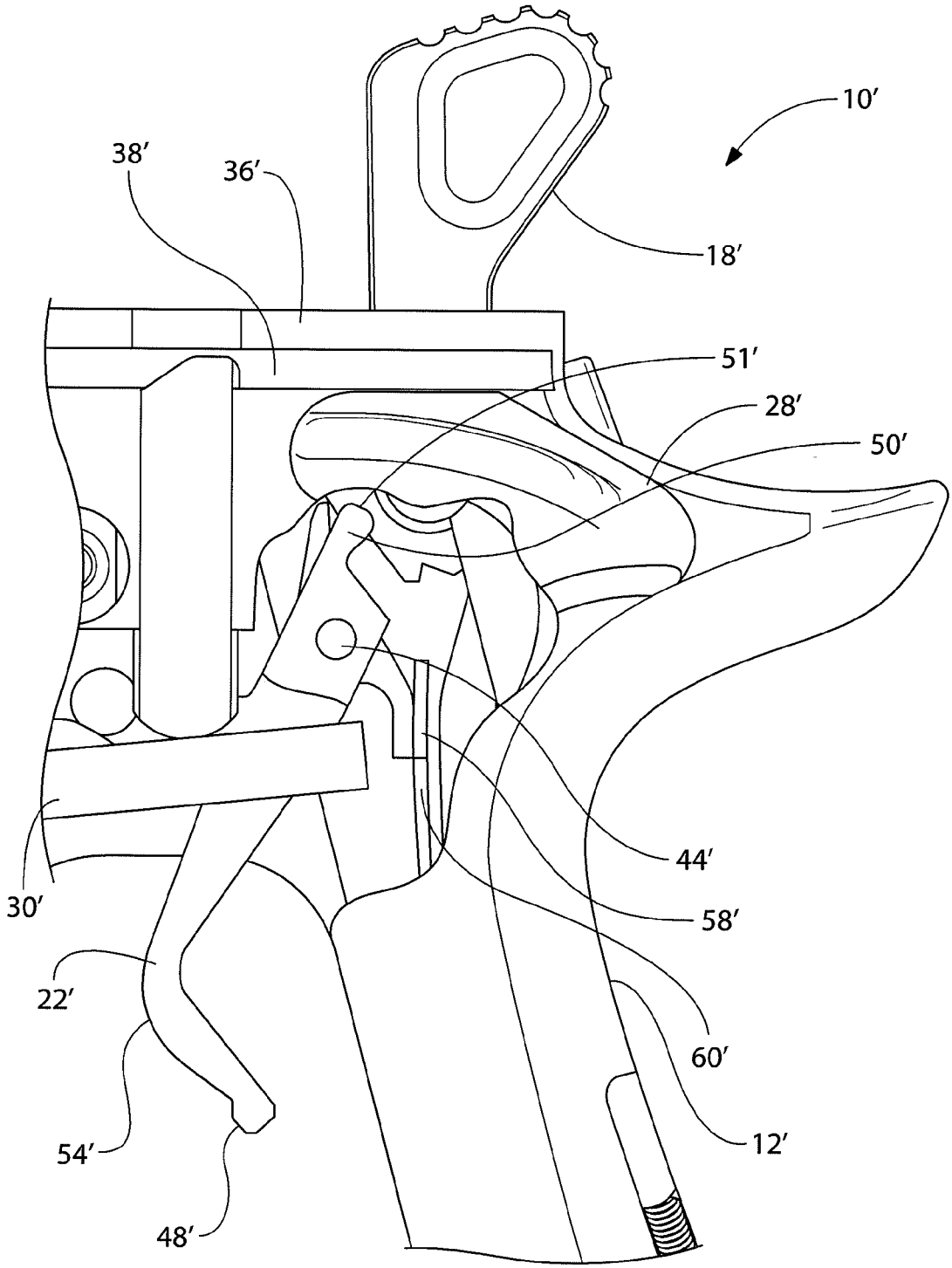
FIG. 5 (PRIOR ART)
FIG. 5 is an isometric view of the frame and internal components of a prior art pistol with its ejector shown in an undesirable condition.

FIG. 5 is a view of the frame and internal components of a prior art pistol with its ejector shown in an undesirable condition. For convenience sake, the various elements of this prior art pistol use the same reference characters as in the pistol 10 of FIGS. 1-4, but having a prime symbol after the reference character. For example, the pistol 10 of FIGS. 1-4 is designated pistol 10' in FIG. 5. FIG. 5 shows a pistol 10' where its ejector 22' has been inadvertently over-rotated so that its second end 50' has passed its sear spring 60' to a position where it cannot be readily moved back to a proper operating position. The present invention addresses this drawback of the prior art.

While the invention has been described in detail and with reference to specific examples thereof, it will be apparent to one skilled in the art that various changes and modifications can be made therein without departing from the spirit and scope thereof.

What is claimed is:

1. A pistol having a device to prevent ejector over-rotation, comprising:

(a) a frame comprising a handle portion for receipt of a magazine, a barrel portion for receipt of a barrel, and an upper rear portion for receipt of a firing mechanism, the upper rear portion having a left side wall and a right side wall;

(b) an elongate ejector having a first end, a second end and a pivot point between the first end and the second end, the first end having a cam surface for ejection of a spent case, the second end for contacting an over-rotation stop, the ejector rotatably disposed in the frame between the left side wall and the right side wall at the pivot point;

(c) a sear spring disposed adjacent to said upper rear portion, said sear spring having at least one cantilevered spring leg disposed adjacent to the second end of the ejector to rotably bias the ejector downward such that the first end of the ejector pivots in an upward direction; and (d) an over-rotation stop disposed between said left side wall and right side wall to engage the second end of the ejector to limit rotational travel of the ejector past the spring leg of the sear spring.

2. The pistol having a device to prevent ejector over-rotation of claim 1, wherein the pivot point is a pivot pin installed through at least one aperture in the frame.

3. The pistol having a device to prevent ejector over-rotation of claim 1, wherein the over-rotation stop is a pin installed through at least one aperture in the frame.

4. A pistol having a device to prevent ejector over-rotation, comprising:

(a) a frame comprising:

(i) a handle portion for receipt of a magazine, a barrel portion for receipt of a barrel, and an upper rear portion for receipt of a firing mechanism, the upper rear portion having a left side wall and a right side wall;

(ii) a left side wall ejector pin aperture, and a right side wall ejector pin aperture, said left side wall ejector pin aperture aligned with the right side wall ejector pin aperture, said left side wall ejector pin aperture and said right side wall ejector pin aperture disposed in the upper rear portion for receipt of an ejector pivot pin; and (iii) at least one over-rotation pin aperture in at least one of said left side wall and right side wall, said at least one over-rotation pin aperture disposed adjacent to said ejector pin apertures;

(b) an elongate ejector having a first end, a second end and a pivot point aperture between the first end and the second end, the first end having a cam surface for ejection of a spent case, the second end for contacting an over-rotation pin, the ejector rotatably disposed in the frame between the left side wall and the right side wall by an ejector pivot pin;

(c) a sear spring disposed adjacent to said upper rear portion, said sear spring having at least one cantilevered spring leg disposed adjacent to the second end of the ejector to rotatably bias the ejector downward such that the first end of the ejector pivots in an upward direction; and (d) the over-rotation pin disposed in said over-rotation pin apertures to provide an over-rotation stop to engage the second end of the ejector to limit rotational travel of the ejector past the cantilevered spring leg of the sear spring.

* * * * *